United States Patent [19]

Clark

[11] 4,080,135

[45] Mar. 21, 1978

[54] APPARATUS FOR FORMATION OF PRODUCTS FROM TEMPORARILY PLASTIC MATERIALS

[76] Inventor: William Alfred Clark, 67 Coates Ave., Auckland, New Zealand

[21] Appl. No.: 721,714

[22] Filed: Sep. 9, 1976

[30] Foreign Application Priority Data

Nov. 18, 1975 New Zealand ..... 179278

[51] Int. Cl.[2] ..... B28B 1/44; B28B 3/08; B28B 7/18; B28B 11/12

[52] U.S. Cl. ..... 425/290; 425/298; 425/308; 425/352; 425/393; 425/414; 425/420; 425/DIG. 218; 249/145

[58] Field of Search ..... 425/290, 298, 308, 310, 425/329, 352, 353, 354, 355, 356, 393, 404, 414, 420, 192, 193, DIG. 218; 249/145

[56] References Cited

U.S. PATENT DOCUMENTS

| | | | |
|---|---|---|---|
| 2,704,875 | 3/1955 | Kingston | 249/145 |
| 3,340,337 | 9/1967 | Schulge | 425/DIG. 218 |
| 3,458,619 | 7/1969 | Prochaska | 249/145 |
| 3,465,075 | 9/1969 | Siegfreid | 425/393 X |
| 3,487,140 | 12/1969 | Laux et al. | 425/356 X |
| 3,499,067 | 3/1970 | Rogers | 425/393 X |
| 3,557,290 | 1/1971 | Siegfreid et al. | 425/393 X |
| 3,654,992 | 5/1972 | Greene | 425/310 X |

FOREIGN PATENT DOCUMENTS

| | | | |
|---|---|---|---|
| 1,454,998 | 11/1976 | United Kingdom | 429/356 |

*Primary Examiner*—J. Howard Flint, Jr.
*Attorney, Agent, or Firm*—Holman & Stern

[57] ABSTRACT

A method of and machine for forming articles from a temporarily plastic material in which a hollow mould has material in a plastic state placed in it; plungers to form the interior surface of a through pipe operated to displace plastic material in that mould and a further hollow plunger operated to form a further outlet the passageway of which connects with the through passageway.

3 Claims, 8 Drawing Figures

APPARATUS FOR FORMATION OF PRODUCTS FROM TEMPORARILY PLASTIC MATERIALS

Figures 1, 2:
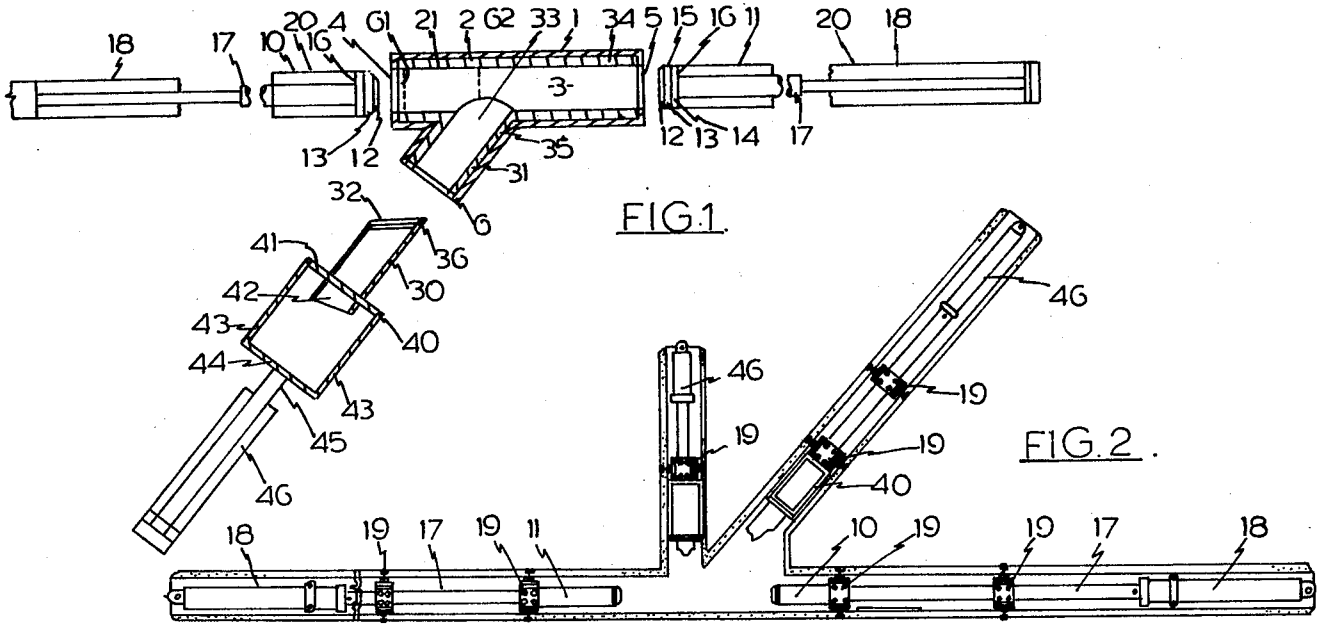

This invention relates to the formation of products from temporarily plastic materials and has been devised particularly though not solely for forming junctions, inspection pipes and other types of earthenware fittings.

At present earthenware fittings such as a Y junction are formed by producing a pipe then while the clay is still green, cutting an aperture in the pipe and joining by hand a further piece of pipe one end of which has been cut at the appropriate angle and contour to fit onto the through pipe. This of course is time consuming and expensive.

It is therefore an object of the present invention to provide apparatus for the formation of products from plastic material which will obviate or minimise the foregoing disadvantages in a simple yet effective manner or which will at least provide the public with a useful choice.

Accordingly in one aspect the invention consists in an apparatus for performing a method of forming articles from a temporarily plastic material the formed article comprising a through tube or pipe with openings at each end and at least one further opening, said method comprising the steps of placing material in a plastic state in a mould box, the shape of which defines the outer shape of the article to be made, placing one end of a plunger or internal die which forms the internal shape of the through pipe in position in the mould box, causing another plunger positioned on the same axial line as the first plunger to pass into the opposite end of the through pipe and to move along the mould box to form the through pipe excess material being expelled through said at least one further outlet from the article to be made, causing the two plungers to meet at about the centre or one edge of said at least one further outlet or to traverse, one or the other, the whole of the through pipe and causing a hollow further plunger or plungers to be passed into said further outlet or outlets to cut a core of the material in the plastic state while leaving walls forming said further outlet in a manner such that said further outlet forms an opening leading into said pipe, withdrawing the plungers and removing the article from the mould.

In a further aspect the invention consists in apparatus for forming articles from a material in its plastic state which articles include a through pipe having an outlet at each end and at least one further outlet or opening intermediate of the length of the through pipe, said apparatus comprising a frame, a mould box the internal shape of which defines the external shape of the article to be made the mould box being such that the article may be removed therefrom after manufacture, a pair of oppositely directed axially aligned plungers each plunger having an external diameter, which defines the internal diameter of the through pipe, each plunger being operable by a reciprocating means whereby each plunger is moved over a desired reciprocating path and for each at least one further outlet a shaped hollow plunger having an external periphery which forms the inner wall of said at least one further outlet, said hollow plunger having an opening at each end and being operated by a reciprocating means over a desired path, the construction and arrangement being such that on material in a plastic state being placed in said mould box one of said plungers forming said through pipe is positioned at one end of the die box, the other plunger is then operated to force plastics material out of its way to form the walls of the through pipe, excess material being discharged into the mould box to form said at least one further outlet, said first plunger being then repositioned as desired until the plungers meet and said hollow plunger being then operated to cut a core out of each said at least one further outlet so as to leave a passageway connecting with said through pipe.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

Figure 3:
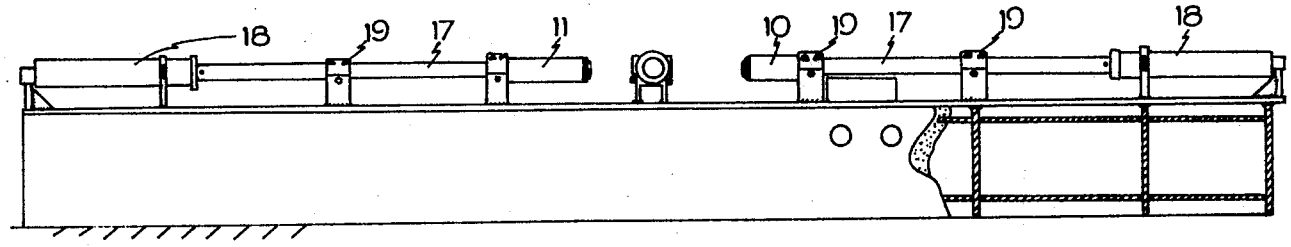
Figure 4:
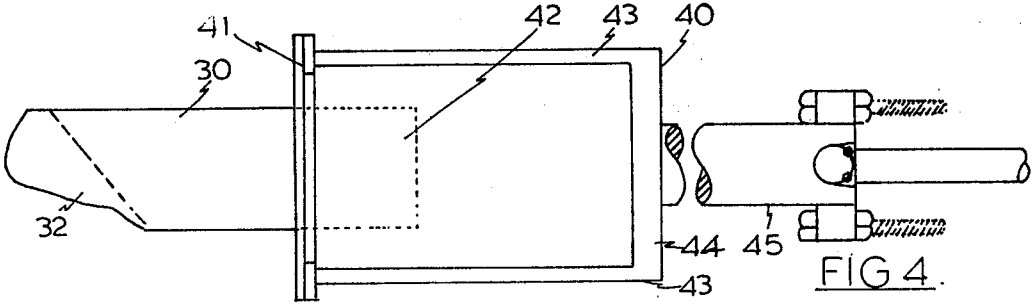
Figure 5:
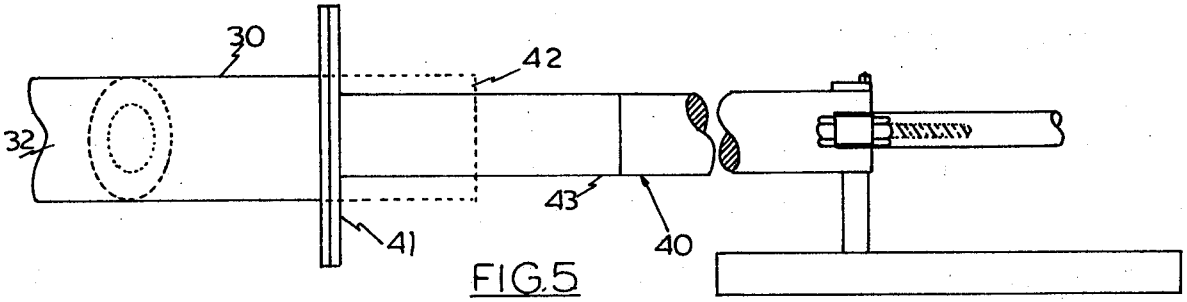
Figure 6:
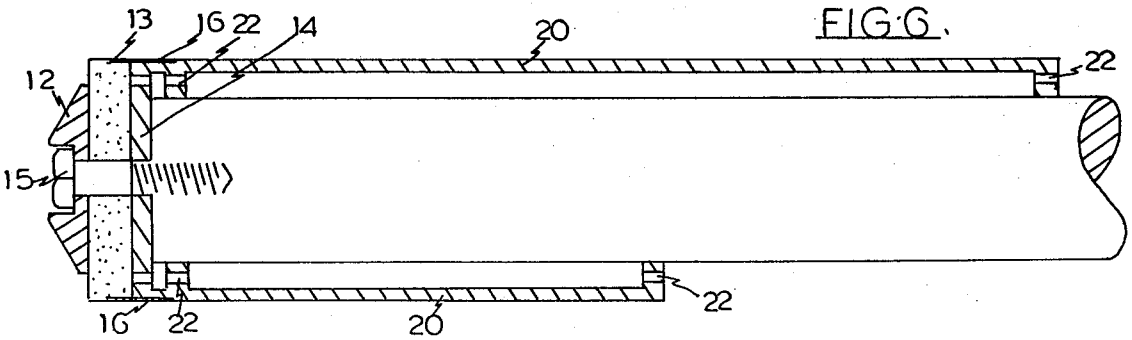
Figures 7, 8:
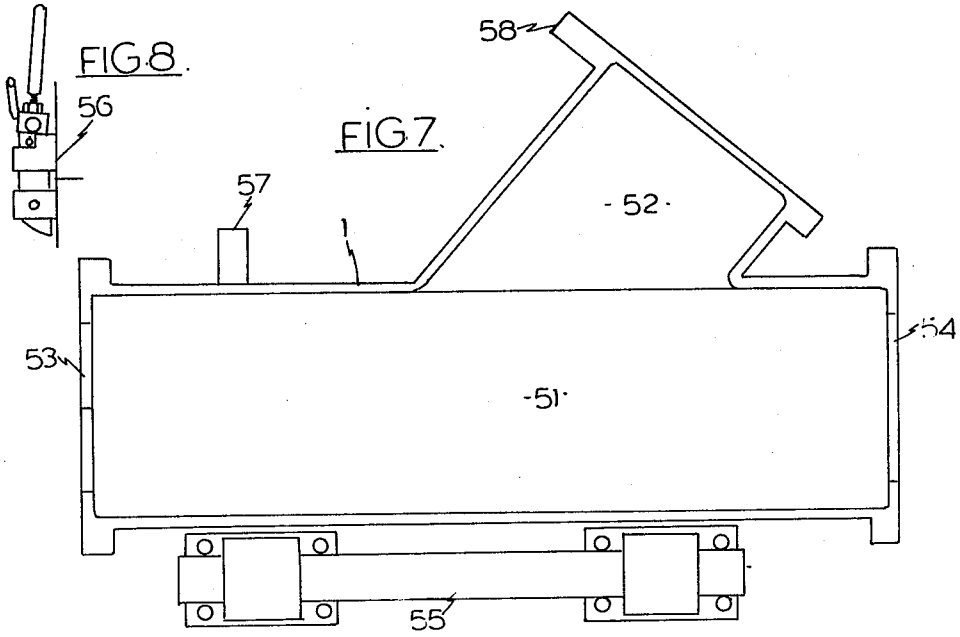

One preferred form of the invention will now be described with reference to the accompanying drawings in which, FIG. 1 is a diagrammatic plan view of apparatus according to the invention, FIG. 2 is a plan view as FIG. 1 with a mould box not being mounted thereon but showing plungers for both square and Y junction manufacture, FIG. 3 is a side elevation of the construction shown in FIG. 2, FIGS. 4 & 5 are a plan and elevational views respectively of a branch forming hollow plunger, FIG. 6 is a cross section of a through pipe forming plunger alternative lengths of plunger being shown on either side of the centre line, FIG. 7 is a plan view of the lower part of a mould box according to the invention, the upper half being complementary, FIG. 8 is a sketch view of a toggle lock used to keep the mould box parts in engaged disposition during forming of an article.

Referring to the drawings a mould box 1 is provided, the internal shape of which determines the external shape of the article to be manufactured. As may be seen in the drawings that article is exemplified as being a Y junction and the preferred material which is in its plastic state when being formed on the apparatus now to be described is clay so that an earthenware pipe is produced after firing in the known way. However, the invention is not limited to such articles or such material which is plastic when being formed. Thus the material which is plastic during formation may comprise wet concrete, a thermoplastic material or other suitable material capable of being in a plastic state when being formed. The article may be either Y or square junctions or inspection pipes or may comprise other articles which comprise a through pipe having an outlet at each end and at least one further branch with one outlet intermediate of the length thereof. Thus in the drawings the pipe 2 to be formed has a through pipe 3 having an outlet 4 and an outlet 5 in the same axial line and a further branch outlet 6. However, for an X junction there would be two outlets such as the outlet 6 and for an inspection pipe the upper mould part has a part which defines an opening in the through pipe.

The mould box 1 is preferably in two halves so that the article after moulding may be removed therefrom as will be referred to later.

Opposite the openings 4 & 5 a pair of plungers or internal dies 10 and 11 are provided. These plungers are operated to form the internal walls of the article 2 and to this end the plungers are provided with end members comprising a metal disc 12 (FIG. 6) an expandable material such as felt 13 and a further metal disc 14. These parts are held together by a bolt 15. A stainless steel short cylinder 16 provides a wearing strip. Pressure is applied by a ram rod 17 running in bearings 19 and connected to a piston and cylinder assembly 18 to which a fluid under pressure, preferably hydraulic fluid is supplied, so that when the metal plate 12 comes against material in the plastic state within the mould box 2 the felt disc 13 will expand radially to give some clearance between the wall 20 of the plunger and the wall 21 of the article being formed. Air holes 22 permit air from the plastic material which filters through the felt 13 to escape to atmosphere.

For each further branch outlet in the article 2, for example, the branch outlet 6 shown in FIG. 1 a hollow plunger 30 is provided of a suitable shape to form the inner wall 31 of the further branch outlet 6. The hollow plunger 30 has a reasonably sharp edge 32 and may for example, be formed of say 16 gauge stainless steel and the edge 32 is preferably shaped so that it conforms to the inner shape or line 33 which is the junction between the through pipe 34 and the junction pipe 35 formed as will be described further shortly. The hollow plunger 30 forms a core and to reduce friction of this core against the inner walls of the hollow plunger 30 an enlargement 36 of the thickness of the hollow plunger 30 is provided near the cutting edge 32 so that the core is of reduced diameter within the hollow plunger 30.

So that cores may be discharged from the hollow plunger 30 an open cage arrangement 40 is provided comprising a plate 41 having a hole in it through which cores 42 may pass and a plurality of bars 43 fixed to a pressure member 44 fixed to a piston rod 45 of a piston and cylinder assembly 46 again to which fluid preferably hydraulic fluid is supplied to cause reciprocation of the hollow plunger 30.

In FIGS. 2 & 3 both a square junction and a Y junction making arrangement is shown the actual ram used in conjunction with selection of the required type of mould box determining the type of junction made.

In FIG. 8 the lower half of a mould box 1 is shown the inner surfaces of main pipe mould 1 and branch pipe mould 2 being semi cylindrical and the semi cylindrical openings 53 and 54 being of a size as to receive the plungers 10 and 11. The upper half of the mould box 1 is complementary and is hinged to the shaft 55 and toggle clamps 56 (FIG.9) clamps lugs 57 and 58 on the bottom mould part to corresponding lugs on the top mould parts.

The operation of the construction is as follows:

A suitable sized preferably cylindrical block of material in the plastic state, for example, clay which has been prepared is placed in the mould box 1 and the left hand plunger 10 is FIG. 1 is entered through the opening 4 to a position of about the pecked line 61. The right hand plunger 11 is then entered through the opening 5 and presses material from in front of it distributing some of it against the wall of the mould box to form the through pipe 34, the felt pads 13 expanding as above described to give clearance, these felt pads having been first oiled with, for example, a mixture of stearin and kerosene and as a result of this forcing of the plunger 11 along the through pipe excess material is discharged into the branch mould 52. This is continued until the plunger 11 reaches about the pecked line 62 and the plunger 10 is then moved from position 61 to position 62 i.e. until the two plungers meet. Some overlap may be effected by withdrawing one or other of the plungers and advancing the other so that the through pipe is cleaned right through at the internal diameter thereof. The effect of advancing plunger 11 drives the material out of the opening 6 but there is an area referenced 53 which may not be completely filled with clay. Accordingly the advancement of the plunger 10 completes this filling operation and provides a homogeneous arrangement. The hollow plunger 30 is then advanced to cut a core forming the further branch outlet 6 and the plungers are then withdrawn, the mould box opened and as a result the article so formed may be removed from the mould box a further block of material in the plastic state placed in the mould box and the operation may be continued.

It will be apparent that the hollow plunger 30 is advanced until it penetrates into the through pipe and this may be effected either with the plungers in position in which case the cutting edge 32 of the hollow plunger 30 must be shaped to give clearance against the plungers or alternatively the plungers may be withdrawn in which event the hollow plunger 30 may be passed right into the through pipe. This latter method however may provide some raggedness at the internal corner and the former is preferred.

As each core is formed it presses the preceding core out through the cage 43, the cores then dropping or being pulled away and the material may be re used if desired.

From the foregoing it will be seen that an extremely simple apparatus is provided which will enable pipes to be made having further outlets associated therewith in a ready and effective manner and the increase in through put as compared with the present manual production of such pipes is considerable.

I claim:

1. Apparatus for forming articles from a material in its plastic state which articles include a through pipe having an outlet at each end at least one further outlet or opening intermediate of the length of the through pipe, said apparatus comprising a frame, a mould box the internal shape of which defines the external shape of the article to be made and the mould box being such that the article may be removed therefrom after manufacture, a pair of oppositely directed axially aligned plungers each plunger having an external diameter, which defines the internal diameter of the through pipe, each plunger being operable by a reciprocating means whereby each plunger is moved over a desired reciprocating path and for each at least one further outlet a shaped hollow plunger having an external periphery which forms the inner wall of said at least one further outlet, said hollow plunger having an opening at each end and being operated by a reciprocating means over a desired path, the construction and arrangement being such that on material in a plastic state being placed in said mould box one of said plungers forming said through pipe is positioned at one end of the die box, the other plunger is then operated to force plastics material out of its way to form the walls of the through pipe, excess material being discharged into the mould box to form said at least one further outlet, said first plunger being then repositioned as desired until the plungers meet and said hollow plunger being then operated to cut a core out of the each said at least one further outlet so as to leave a passageway connecting with said through pipe.

2. Apparatus as claimed in claim 1 wherein said plungers forming said through pipe have discs or rings of an expandible material at the end which are compressed against the material in a plastic state to form the same.

3. Apparatus as claimed in claim 1 wherein said first and second plungers have air vents whereby air is vented from the plastic material during operation of said plungers.

* * * * *